United States Patent [19]

Noll

[11] Patent Number: 4,525,986

[45] Date of Patent: Jul. 2, 1985

[54] APPARATUS AND PROCESS FOR INSERTING INSERTS INTO ENVELOPES

[76] Inventor: Marvin H. Noll, 208 Howard Ave., Passaic, N.J. 07055

[21] Appl. No.: 425,890

[22] Filed: Sep. 28, 1982

[51] Int. Cl.[3] ..... B65B 43/39; B65B 43/52

[52] U.S. Cl. ..... 53/569; 53/252; 53/266 A

[58] Field of Search ..... 53/266 A, 251, 252, 53/460, 570, 459, 569

[56] References Cited

U.S. PATENT DOCUMENTS

| | | | |
|---|---|---|---|
| 1,960,959 | 5/1934 | Sague | 53/569 X |
| 3,015,926 | 1/1962 | Galambos | 53/266 A X |
| 3,858,381 | 1/1975 | Huber et al. | 53/569 |
| 3,965,644 | 6/1976 | Stocker | 53/569 X |
| 3,974,623 | 8/1976 | Bate | 53/252 X |

FOREIGN PATENT DOCUMENTS

| | | | |
|---|---|---|---|
| 1181618 | 11/1964 | Fed. Rep. of Germany | 53/252 |

*Primary Examiner*—Horace M. Culver

*Attorney, Agent, or Firm*—Anthony J. Casella; Gerald E. Hespos

[57] ABSTRACT

An apparatus and process for continuously and sequentially inserting inserts in envelopes are disclosed. The apparatus includes parallel and adjacent insert and envelope conveyors which continuously move inserts and envelopes at identical speeds. An insert cam is disposed adjacent the insert conveyor and includes a portion which causes each insert to slidably move toward the envelope conveyor at the same time that the inserts are being moved parallel to the envelope conveyor. Envelopes are fed onto the envelope conveyor with their flaps up and adjacent and parallel to the insert conveyor. The flaps are opened by a flap opening cam thereby enabling the inserts to sequentially enter the envelopes as the inserts are slidably moved toward the envelope conveyor. A cam then closes the flap on the inserted envelope and the envelope conveyor ejects the inserted and closed envelopes to appropriate locations for further processing.

18 Claims, 7 Drawing Figures

APPARATUS AND PROCESS FOR INSERTING INSERTS INTO ENVELOPES

BACKGROUND OF THE INVENTION

Envelope inserting apparatus are used in many instances where the volume of envelopes to be filled makes manual insertion impractical. Machines for inserting planar articles into envelopes frequently are used by high volume mailers such as banks, insurance companies, government agencies and commercial mailing establishments.

The prior art includes many types of envelope inserting machines. One type of prior art envelope inserter uses a plurality of vacuum operated suction devices in combination with mechanical devices which advance the envelopes and inserts through the system. More particularly, this type of prior art envelope inserter employs a vacuum to feed inserts and envelopes into the apparatus. The inserts and envelopes then are mechanically advanced on separate conveyors. At an appropriate location in this prior art inserter, the envelope and insert conveyors are stopped, and a second vacuum apparatus is employed to open the envelope sufficiently to enable the envelope to accept the insert. While the mechanical conveyors are stopped, the insert is pushed in a direction substantially perpendicular to its previous direction of movement and into the envelope that has been opened by the vacuum apparatus. This prior art apparatus then mechanically conveys the envelope, with the insert included, to other locations where the envelope is sealed, posted, and sorted for distribution.

The vacuum operated prior art envelope inserting machine has several disadvantages. First, the vacuum system, which is central to this prior art inserter, sucks in a substantial volume of dust and small paper particles. Consequently, this prior art apparatus is subject to frequent malfunctions. Specifically, the machine frequently feeds either too few or too many inserts onto the mechanical conveyor. In other instances, the vacuum fails to properly open the envelope thereby preventing complete insertion of the insert. In view of these problems, prior art machines of this type require frequent cleaning and maintenance which is costly and which results in substantial down time. Second, the mechanical conveyors in the prior art vacuum operated inserters are abruptly stopped and started each time an insert is placed in an envelope. This abrupt and frequent lurching places a tremendous strain on many parts of the apparatus, and in turn, eventually causes those parts to fail. Additionally, the periodic stopping and starting substantially reduces the maximum output of this prior art apparatus. For example, in most operating environments, prior art machines of this type cannot realistically be operated to insert more than 7,000 envelopes per hour. Attempts to increase the speed at which the insert approaches the envelope have led to additional problems because the leading edge of the accelerating insert frequently lifts out of the plane of the remainder of the insert and slides over the top of the envelope opening.

Other prior art inserting apparatus have been developed which rely upon friction to feed inserts and envelopes into the apparatus and to open the envelopes wide enough to accept the inserts. Although this latter type of prior art inserter overcomes the previously described problems associated with vacuum systems, the mechanical components that replace the vacuum system require significantly more moving parts, and therefore have a high probability of mechanical failure. Additionally, the latter type of prior art inserter requires a distinct stopping and starting step each time an insert is placed in an envelope. As explained above, frequent stops and starts contribute to stress related mechanical failures and significantly affect the maximum operating speed of the inserter.

In view of the above, it is an object of the subject invention to provide an automatic inserting apparatus for envelopes that operate with a minimum number of moving parts.

It is another object of the subject invention to provide an automatic inserting apparatus for envelopes which does not rely upon a vacuum system.

It is an additional object of the subject invention to provide an automatic inserting apparatus for envelopes that enables the continuous and simultaneous movement of both the envelopes and the inserts.

It is still another object of the subject invention to provide an automatic inserting apparatus for envelopes that enables inserts to be placed in envelopes at a faster rate than existing inserters.

SUMMARY OF THE INVENTION

The automatic inserting apparatus of the subject invention includes an insert conveyor and an envelope conveyor both of which are mounted on a frame and are continuously driven by a motor. The insert conveyor cooperates with an insert feeder which ejects inserts onto the insert conveyor. The insert conveyor is an elongated loop which moves the inserts in a direction generally parallel to the longitudinal axis of the loop. The insert conveyor also cooperates with an insert cam which controls the movement of the inserts in a direction orthagonal to the longitudinal axis of the insert conveyor at the same time that the inserts are being moved parallel to the longitudinal axis of the insert conveyor. Thus, the insert conveyor and the insert cam cooperate to move the inserts in a direction angularly related to the longitudinal axis of the insert conveyor.

An envelope feed mechanism ejects envelopes onto the envelope conveyor which moves envelopes at the same speed and in the same direction as inserts on the insert conveyor. The envelope conveyor is parallel and adjacent to the insert conveyor, and is on the side of the insert conveyor toward which the inserts are moved by the insert cam. Each envelope is fed onto the envelope conveyor such that the side of the envelope on which the address is placed is faced down and such that the opening flap is adjacent the insert conveyor. A flap opening cam is mounted on a portion of the frame adjacent the envelope feed device. Movement of the envelope along the envelope conveyor causes the envelope to come into contact with the flap opening cam. The sliding interaction between the flap opening cam and the moving envelope causes the flap of the envelope to be opened and rotated approximately 180° into the plane of the remainder of the envelope. The portion of the envelope conveyor adjacent the flap opening cam is inclined with respect to the insert conveyor, such that the envelopes on the envelope conveyor are advancing in an upward direction. This incline, in cooperation with the flap opening cam enables the envelope flaps to be opened and properly positioned with respect to the insert conveyor with a minimum of moving parts.

An envelope opening assembly is mounted on the frame adjacent the envelope and insert conveyors, and aligned with the portion of the insert cam that causes orthagonal movement of the inserts. The envelope opener includes a plurality of opening fingers mounted upon an elongated loop, the longitudinal axis of which is parallel to the axes of the insert and envelope conveyors. The fingers on the envelope opening assembly move parallel to and at the same speed as the envelopes. In this manner, the fingers can be partially inserted into the envelope to open the envelope slightly as it moves along the envelope conveyor. Thus, in the aligned portions of the insert and envelope conveyors, the inserts are advanced toward the envelope conveyor by the insert cam, and simultaneously the envelopes are opened by the fingers of the envelope opening assembly.

The movement of the inserts caused by the insert cam is of a sufficient magnitude to enable the inserts to be completely placed or inserted into the respective envelopes. This cooperating relationship between the insert conveyor, the envelope conveyor, the insert cam, and the envelope opening assembly enables the inserts to be placed in the envelopes without stopping the longitudinal movement of either the inserts or the envelopes. Consequently, the subject invention minimizes the development of stresses on parts of the subject apparatus in contrast to stresses developed on certain parts of prior art inserting apparatus caused by the frequent stops and starts inherent in the operation of the prior art apparatus. Additionally, the subject invention enables a significantly faster operation by avoiding the need to stop the mcvement of envelopes and inserts each time an insert is placed in an envelope. Specifically, the continuous movement of the subject apparatus will enable insertion rates approaching 40,000 per hour.

In the operation of the subject apparatus, after an insert has been fully inserted into an envelope, the insert and envelope move in unison along the envelope conveyor. A flap closing cam is attached to the frame of the apparatus to enable closing of the flap on the envelope. This rotational movement of the flap can be accomplished with a minimum of moving parts by inclining this portion of the envelope conveyor such that the inserted envelopes are conveyed in a slightly downward direction with respect to the insert conveyor. The inserted envelopes are then removed from the conveyor, and typically are sorted, sealed, addressed, and/or posted.

It is noted that the angular relationship between the insert cam and the longitudinal axis of the insert conveyor determines the speed at which the inserts approach the envelopes. As the insert cam approaches a parallel alignment with the insert conveyor, the speed of insertion as compared to the longitudinal speed of the inserts decreases. Thus, by having a long insert cam and a long insert conveyor disposed at a small angle with respect to one another, both the insert and envelope conveyors may be operated at a very high speed while still having an acceptably and reliably low insertion speed. Consequently, even though the relative insertion speed is low, the apparatus will be able to insert as many as approximately 40,000 envelopes per hour.

DETAILED DESCRIPTION OF THE PREFERRED EMBODIMENT

Figure 1:
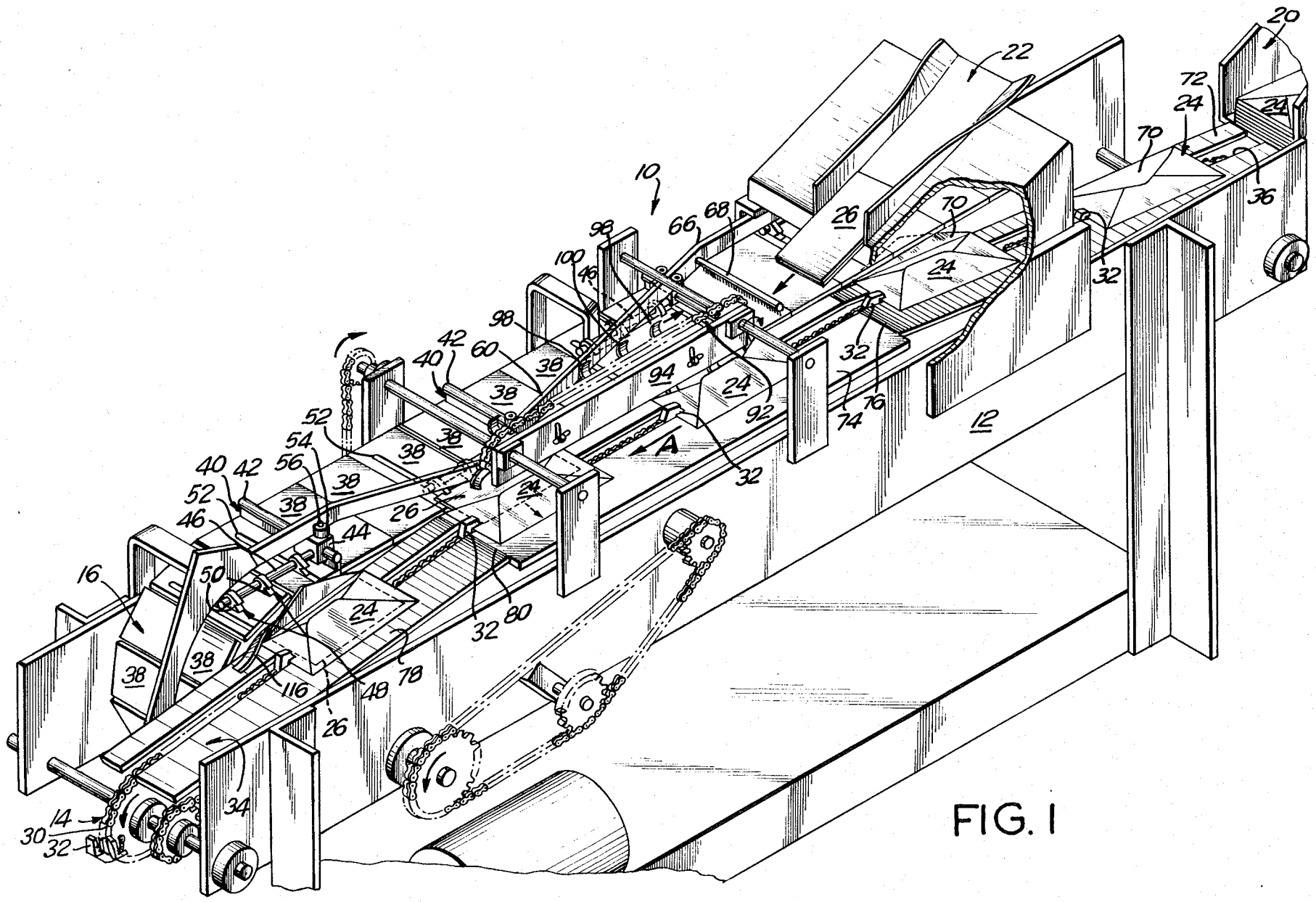
FIG. 1 is a perspective view, partially in section, of the subject automatic inserting apparatus of envelopes.

Referring to FIG. 1, the envelope inserting apparatus of the subject invention is generally indicated by the numeral 10. The inserting apparatus 10 includes a frame 12 on which are mounted an envelope conveyor 14 and an insert conveyor 16. The envelope and insert conveyors 14 and 16 are driven at the same speed by motor 18 such that both the envelope and insert conveyors move in the direction indicated by arrow "A".

Envelope and insert feeders 20 and 22 are mounted on the frame 12, and are operative to eject envelopes 24 and inserts 26 onto the envelope and insert conveyors 14 and 16, respectively. In many inserting operations, it will be desirable to place more than one insert into each envelope, and hence the envelope and insert conveyors 14 and 16 may be made appropriately longer and several insert feeders may be mounted in series on frame 12 so as to sequentially eject one insert on top of another as the inserts move along the insert conveyor 16.

Figure 2:
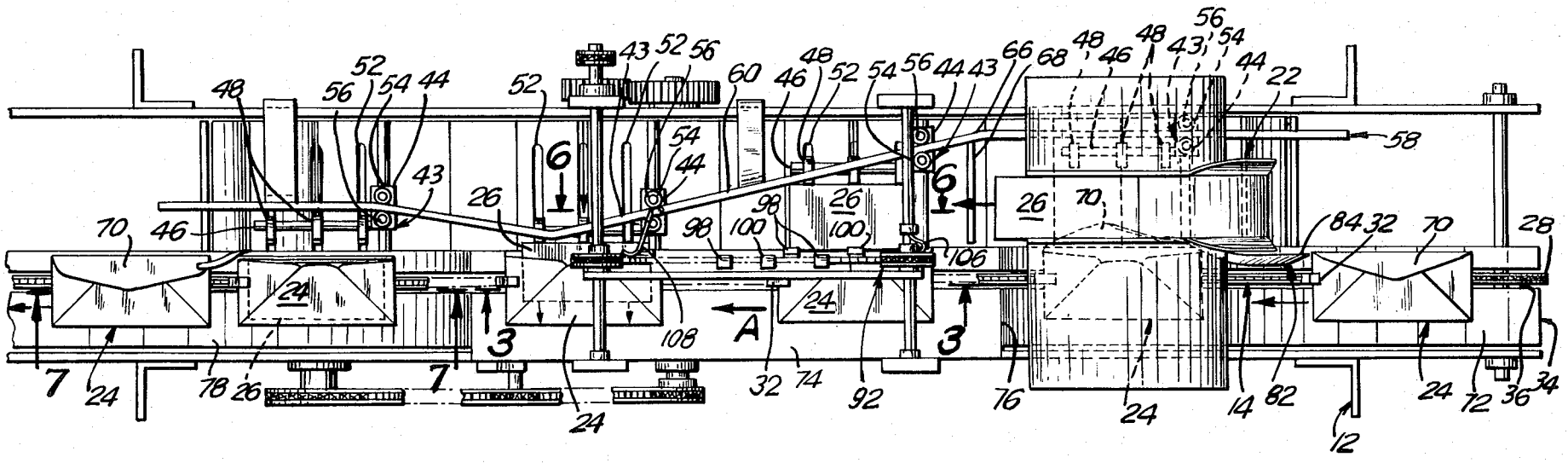
FIG. 2 is a plan view of the apparatus shown in FIG. 1.

As shown in FIGS. 1 and 2, the envelope conveyor 14 is defined by a looped chain having an envelope feed end 28 and an envelope ejection end 30. Spaced at substantially equal intervals along the chain of the envelope conveyor 14 are envelope clamps 32. The latter cooperate with a feed cam (not shown) at the feed end 28 of the envelope conveyor 14 to grasp the leading edge of each envelope 24 ejected onto the envelope conveyor 14 by the envelope feeder 20. More specifically, the envelope feeder 20 ejects each envelope 24 onto an elongated envelope platform 34. The envelope platform 34 includes an elongated slot 36 extending along its entire length. The envelope conveyor 14 is aligned with the slot 36 so that each envelope clamp 32 extends through slot 36 to grasp the envelopes 24 ejected onto the envelope platform 34 by the feeder 20. In this manner, each envelope 24 is pulled along the envelope platform 34 by an envelope clamp 32. A guide rail can be mounted on platform 34 to assure proper alignment of envelopes 24.

The insert conveyor 16 is disposed parallel to and adjacent the envelope conveyor 14. More particularly, the insert conveyor is of a generally tank tread construction, being formed from a plurality of hingedly connected plates 38 which define a closed loop. Fixedly attached to every fourth plate 38 on the insert conveyor 16 is a linear bearing 40 which extends perpendicular to the longitudinal axis of the insert conveyor 16. The spacing of linear bearings 40 can vary according to the size of the inserts 26, the size of the plates 38, and the operating speed of the apparatus. In the apparatus 10, the spacing between linear bearings 40 on the insert conveyor 16 is equal to the spacing between clamps 32 on the envelope conveyor 14. Each linear bearing 40 is substantially upstanding from its respective plate 38 and includes a cylindrical head portion 42.

An insert pusher assembly 43 including a block 44 is slidably mounted on the cylindrical rail portion 42 of each linear bearing 40 so that the block 44 is able to slidably move along its linear bearing 40 in a direction perpendicular to the longitudinal axis of the insert conveyor 16. An insert pusher bar 46 is rigidly mounted on each block 44 of the insert pusher assembly 43, and is disposed perpendicular to the linear bearing 40 and parallel to the longitudinal axis of the insert conveyor 16. More particularly, each insert pusher bar 46 extends from its respective block 44 in the moving direction of the insert conveyor, as indicated by arrow A in FIGS. 1 and 2. Three pusher fingers 48 are mounted on each insert pusher bar 46, with each pusher finger including a V-shaped notch 50 that is disposed on the side of the respective pusher finger 48 nearest the envelope conveyor 14. The plates 38 adjacent each insert pusher bar 46 include grooves 52 which extend parallel to the linear bearing 40 and are aligned with the pusher fingers 48. Each groove 52 is of a sufficient depth such that the pusher finger notch 50 is disposed at or slightly below the surface of its respective plate 38, and is configured to let the pusher finger 48 slidably move therein.

A pair of spaced-apart cam follower rollers 54 are disposed on the portion of each block 44 opposite the linear bearing 40. More particularly, each cam follower roller 54 is rotationally mounted on a post 56 which extends perpendicular to the linear bearing 40 and away from the plate 38 on which the linear bearing 40 is mounted.

An insert cam 58 is fixedly mounted on the frame 12, and extends around the outer periphery of the insert conveyor 16, as shown in FIG. 1, such that each pair of cam follower rollers 54 straddles an insert cam 58. More particularly, the insert cam 58 includes an inserting portion 60 which is diagonally aligned with respect to the longitudinal axis of the insert conveyor 16 such that at points on the insert conveyor 16 nearest the insert feeder 22, the insertion portion 60 of the insert cam 58 is furthest from the envelope conveyor 14. The insertion portion 60 of the insert cam 50 extends diagonally to point 62 where it is closest to the envelope conveyor 14. The retraction or withdrawal portion 64 of the insert cam 50 extends diagonally away from the envelope conveyor beginning at point 62 on the insert cam 58. The withdrawal portion 64 extends generally away from the envelope conveyor 14 as the insert cam 58 continues around the periphery of the insert conveyor 16. The insertion and withdrawal portions 60 and 64 meet again at point 66 which is substantially aligned with the insert feeder 22.

In operation, the cam follower rollers 54 mounted on each block 44 of each insert pusher assembly 43 follow the insert cam 58 as the insert conveyor 16 is moved in direction A. In this manner, block 44 and the insert pusher bar 46 and pusher fingers 48 attached thereto move toward the envelope conveyor 14 as the blook 44 advances along the insertion portion 60 of the insert cam 58. When the cam follower rollers 54 reach point 62 on the insert cam 58 the pusher fingers 48 are closest to the envelope conveyor 14. Continued movement of the insert conveyor 16 in direction A causes the cam follower rollers 54 to move along the withdrawal portion 64 of the insert cam 58. As the cam follower rollers 54 move along the withdrawal portion 64 of the insert cam 58, the pusher fingers 48 move further away from the envelope conveyor 14 until they reach their maximum distance from the envelope conveyor 14. At point 66, which is substantially in line with the insert feeder 22, the insert pusher assembly 43 again will start approaching the envelope conveyor 14.

During operation of the subject apparatus, inserts 26 are ejected onto the insert conveyor 16 by the insert feeder 22 and are urged in direction A by the linear bearings 40 which move in conjunction with the insert conveyor 16. To ensure that each insert 26 is properly aligned with respect to its linear bearing 40, a brush back 68 is mounted upon the frame 12. The brush back 68 urges each insert 26 against its respective linear bearing 40. The brush back 68 is a fixedly mounted flexible structure which extends into contact with the insert conveyor 16 to brush the insert 26 into contact with the linear bearing 40. The brush back 68 is made of a flexible material that will bend to allow the linear bearing 40 to pass, but will resume its original shape to contact and properly align the insert 26. Alternatively, the brush back can be operative to periodically move away from insert conveyor, thus avoiding contact with the linear bearings 40. After the insert is properly positioned by brush back 68, the linear bearing 40 pushes its respective insert 26 in the direction indicated by arrow A.

The cooperation of the cam follower rollers 54 with the insert cam 58 causes each insert 26 to move toward the envelope conveyor 14 as it is advanced in direction A by the insert conveyor 16. More particularly, the movement of the cam follower rollers 54 along the insert portion 60 of the insert cam 58 causes the respective insert pusher bar 46 and pusher fingers 48 to be moved toward the envelope conveyor 14. As the pusher fingers 48 slidably advance through grooves 52 toward the envelope conveyor 14, the notch 50 in each pusher finger 48 engages the respective insert 26 and urge insert 26 toward the envelope conveyor 14. As the cam follower rollers 54 advance along the withdrawal portion 64 of the insert cam 58, the pusher fingers will move away from the envelope conveyor 14. However, as explained hereinafter, the insert 26 will, at this time, already have been fully inserted into the envelope 24 and will be carried in direction A by its respective envelope 24.

Returning to the envelope conveyor 14 of the subject apparatus 10, envelopes 24 are ejected onto the platform 34 by the envelope feeder 20. More particularly, each envelope 24 is ejected onto platform 34 such that the face of the envelope on which the address would be placed faces platform 34, and such that the side of the envelope 24 to which the flap 70 is hingedly connected is disposed substantially parallel to and adjacent the insert conveyor 16.

The envelope feeder 20 is synchronized with the envelope conveyor 14 so as to eject envelopes 24 onto the platform 34 at a rate that is equal to the rate at which clamps 32 enter the slot 36. This is accomplished by having the envelope feeder 20 and the envelope conveyor 14 both driven by motor 18 with compatible arrays of gears.

Each clamp 32 is of a generally C-shaped configuration with the open end of the C-shape being directed toward the feed end 28 of the envelope conveyor 14. The clamps 32 are in their open disposition as they enter the slot 36 at the feed end 28 of the envelope conveyor 14. To ensure that each envelope 24 is properly positioned in its respective clamp 32, the envelope feeder 20 ejects envelopes 24 at a speed which is slightly greater than the linear speed at which the clamps 32 move through the slot 36. A clamp closing cam (not shown) is mounted on frame 12 and positioned with respect to the feed end 28 of the envelope conveyor 14 so as to cause clamp 32 to be closed at a location where the envelopes 24 are properly seated in clamp 32. In this manner, each clamp 32 grasps its respective envelope 24, and pulls the envelope 24 along the platform 34 in direction A.

The platform 34 onto which the envelopes 24 are ejected includes three segments which are angularly related with respect to one another. Specifically, the envelope receiving section 72 onto which the envelopes 24 are ejected and along which the envelopes are initially grasped by clamps 32 is inclined so that the envelopes 24 are moved in a generally upward direction. The envelope insertion section 74 of the platform 34 is substantially horizontally aligned and is connected to the envelope receiving section 72 at the first transition point 76. The envelope removal section 78 of the platform 34 is connected to the envelope insertion section 74 of the platform 34 at the second transition point 80. The envelope removal section 78 is inclined with respect to the envelope insertion section 74 so that envelopes which are pulled by the envelope conveyor 14 are moved in a generally downward direction. As shown in FIG. 1, envelope and insert conveyors 14 and 16 are dimensioned to ensure that at least part of the inclined envelope receiving and envelope removal sections 72 and 78 of platform 34 are disposed adjacent the insert conveyor 14.

A flap opening cam 82 is rigidly mounted on the frame 12 adjacent the envelope receiving section 72 of platform 34. More particularly, the flap opening cam 82 is an elongated strip which is twisted 180° along its length. The flap opening cam 82 includes an opening end 84 which is the portion of flap opening cam 82 nearest the feed end 28 of the envelope conveyor 14. The opening end 84 of the flap opening cam 82 is spaced slightly from the platform 34 so that as the envelope 24 is pulled along platform 34 by the clamp 32, the opening end 84 of the flap opening cam 82 slidably enters the space between the body portion of envelope 24 and the flap 70. Thus, as the envelope 24 is pulled along the platform 34 by the clamp 32, a twist in the flap opening cam will cause the flap 70 of envelope 24 to be rotated 180°. An additional cam (not shown) may be provided to contact the hinged connection of flap 70 to envelope 24 in such manner as to cause flap 70 to open slightly, thereby facilitating the slidable entry of flap opening cam 80 into the space between flap 70 and the body of envelope 24.

The flap opening cam 82 is located with respect to the envelope receiving section 72 of the platform 34 and with respect to the insert conveyor 16 such that as the flap 70 of the envelope 24 slidably engages the flap opening cam 82, the flap 70 is rotated into a position on the inside of the loop formed by the insert conveyor 16. More particularly, the flap 70 is rotated into the generally wedge-shaped space defined between the substantially horizontal portion of the insert conveyor 16 and the inclined envelope receiving section 72 of the platform 34. As the envelope 24 passes the first transition point 76 on the platform 34, the flap 70 moves into a plane parallel to and adjacent to the plates 38 of insert conveyor 16, and onto the faces of plates 38 opposite the inserts 26.

The envelopes 24 and the inserts 26 are aligned with one another and move at identical speeds as they move on the respective envelope and insert conveyors 14 and 16 past the envelope insertion section 74 of the platform 34. The envelope insertion section 74 of the platform 34 is substantially aligned with the insertion portion 60 of the insert cam 58. Thus, as the envelopes 24 are pulled along the substantially horizontal envelope insertion section 74 of platform 34, the cooperation of the cam follower rollers 54 with the insert cam 58 causes the insert 26 to move toward its respective envelope 24 at the same time both the envelope and insert 24 and 26 are moved in direction A. As shown in FIGS. 1 and 2, the insert 26 will gradually advance into its respective envelope 24 as the envelopes 24 and inserts 26 move in direction A along the envelope insertion section 74 of platform 34.

Figure 3:
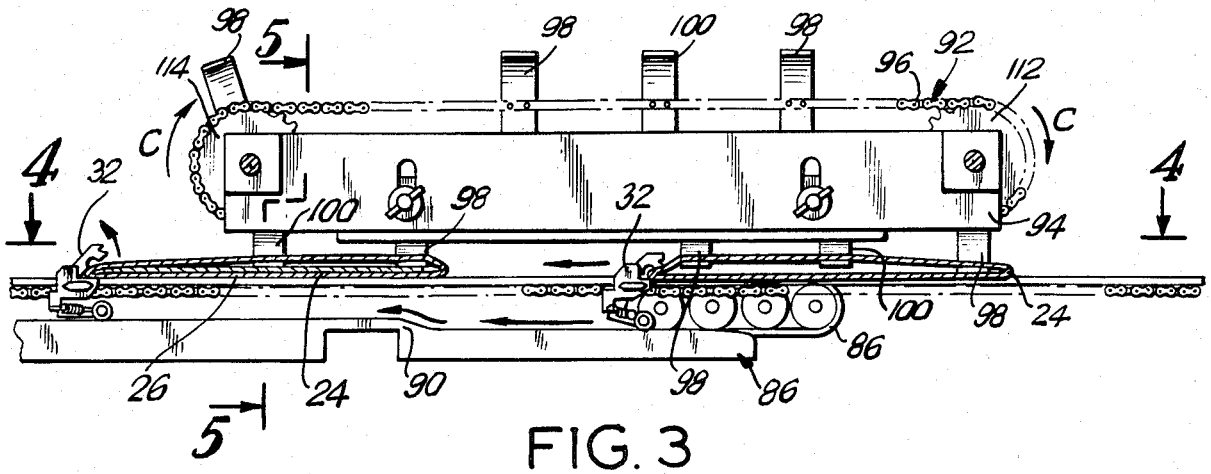
FIG. 3 is a cross-sectional view taken along line 3—3 in FIG. 2.

To assure that the grasping of the envelope 24 by the clamp 32 does not interfere with the movement of insert 26 into envelope 24, clamps 32 are opened as the envelopes advance along the envelope insertion section 74 of platform 34, and the envelopes are advanced along section 74 by the flap conveyor 86, as shown in FIG. 3. More particularly, the flap conveyor 86 is disposed within the loop of the insert conveyor 16 parallel to and adjacent to the envelope insertion section 74 of the platform 34. The flap conveyor 86 moves at the same speed as the envelope and insert conveyors 14 and 16, and preferably is constructed from an elastomeric material that will frictionally engage the paper envelope 24. As the envelope 24 moves along the portion of platform 34 adjacent the flap conveyor 86, the flap 70 of envelope 24 moves into a position intermediate the insert and flap conveyors 16 and 86. The frictional engagement of the flap 70 by the flap conveyor 86 is sufficient to cause envelope 24 to move along platform 34 in direction A.

The clamp releasing cam bar 88 (see FIG. 3) is an elongated member which is aligned with the envelope conveyor 14 and which is disposed between the two ends of the flap conveyor 86. The clamp releasing cam 88 includes a raised portion 90 which causes the clamp to open. Thus, as the clamp 32 contacts the raised portion 90 of the clamp releasing cam 88, the clamp 32 opens and the envelope 24 is advanced along platform 34 by the frictional engagement of the flap conveyor 86 with the flap 70. At a point along platform 34 where the insert 26 is fully inserted into the envelope 24, the raised portion 90 of the clamp releasing cam 88 terminates thereby causing the clamp 32 to grasp the inserted envelope 24. The end of the raised portion 90 of the clamp releasing cam 88 is intermediate the opposed ends of the flap conveyor 86. As a result, apparatus 10 of the subject invention ensures that the inserted envelope 24 will be properly pulled by clamp 32 after the envelope has passed the flap conveyor 86.

To assure that the envelopes 24 are opened sufficiently to accept the inserts 26 as the envelopes 24 move along the envelope insertion section 74 of platform 34, an envelope opening assembly 92 is provided, as shown in FIGS. 3 through 6. The envelope opening assembly 92 includes a frame 94 which is rigidly mounted on the frame 12 of the apparatus 10. The envelope opening assembly 92 includes a chain 96 which is parallel to the platform 34 and disposed above and adjacent to the edge of platform 34 nearest the insert conveyor 16. The chain 96 is driven in the direction indicated by arrows C at the same linear speed as the insert and envelope conveyors 14 and 16.

Figure 5:
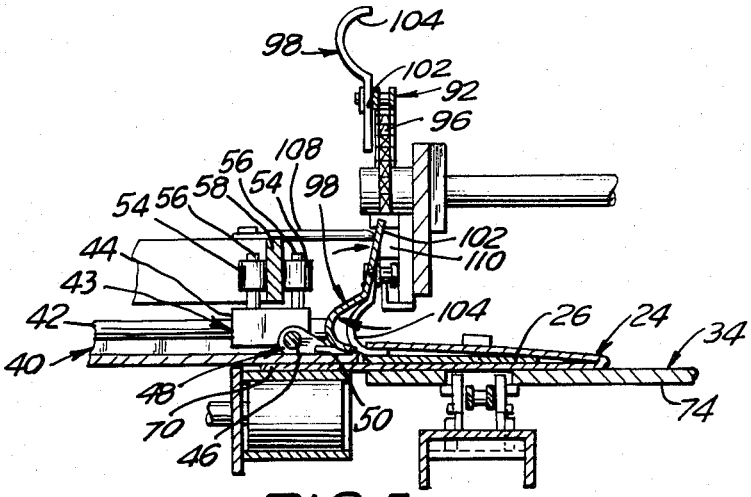
FIG. 5 is a cross-sectional view taken along line 5—5 in FIG. 3.
Figure 6:
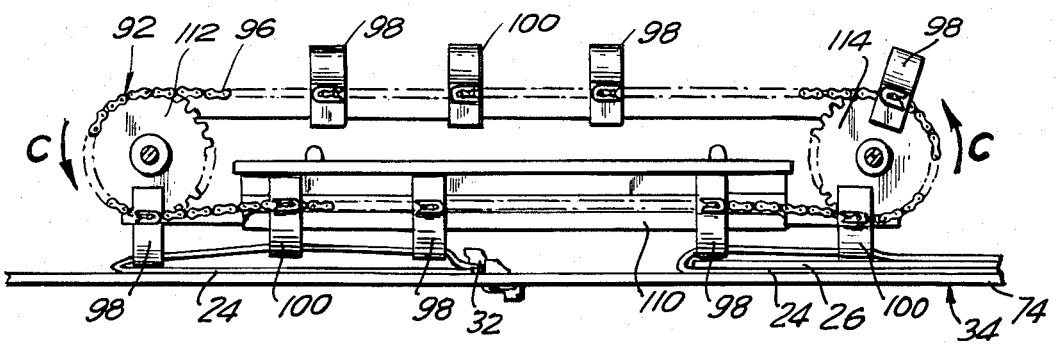
FIG. 6 is a cross-sectional view taken along line 6—6 in FIG. 2.

A plurality of spring fingers 98 and 100 are mounted on the chain 96, as shown most clearly in FIGS. 3, 5 and 6. The spring fingers 98 and 100 are grouped in sets along chain 96 such that each set includes one large spring finger 100 disposed intermediate a pair of small spring fingers 98. This arrangement of small and large spring fingers 98 and 100 reflects the generally V-shaped configuration of the opening of most envelopes. Envelopes having different opening shapes can be accommodated with different arrangements of spring fingers. The linear distance between each set of spring fingers 98 and 100 measured along the length of chain 96 equals the linear distance between clamps 32 on the envelope conveyor 14 and the distance between the linear bearings 40 on the insert conveyor 16. As shown in FIG. 5, each spring finger 98 (100) includes a straight mounting portion 102 (103) and an arcuate portion 104 (105). As explained further below, the arcuate portions 104 and 105 are operative to both open each envelope 24 and to guide each insert 26 into its respective envelope 24.

The envelope opening assembly 92 further includes a finger inserting cam 106 and a finger removal cam 108. The finger inserting and removal cams 106 and 108 are operative to urge the arcuate portion 104 toward or away from the envelope 24. The envelope opening assembly 92 also includes a chain guide 110 which causes the chain 96 to move away from and then toward the platform 34 as the chain 96 moves in the direction C, as shown in FIG. 6.

In operation, as chain 96 moves in direction C around gear 112, the finger inserting cam 106 will urge each spring finger 98 and 100 into an alignment where the arcuate portions 104 and 105 will be inserted into the envelope 24, and where the mounting portions 102 and 103 will be aligned to slidably move against the chain guide 110. As the spring fingers 98 and 100 advance in direction C toward the chain guide 110, they are lifted by chain guide 110 away from platform 34, thereby causing the spring fingers 98 and 100 to open the envelopes. As shown most clearly in FIG. 4, the central portion of each envelope 24 is slightly further away from the insert conveyor 16 than either end portion of the envelopes 24. For this reason, the large spring fingers 100 have been provided to ensure that the central portion of each envelope 24 will be properly grasped to ensure opening of the envelope 24. On different size and/or shape envelopes 24, spring fingers with different sizes may be required. Additionally, it may be necessary to provide more or fewer spring fingers for each envelope. Because of these variables, the spring fingers are removably mounted on the chain 96 to facilitate their replacement.

Figure 4:
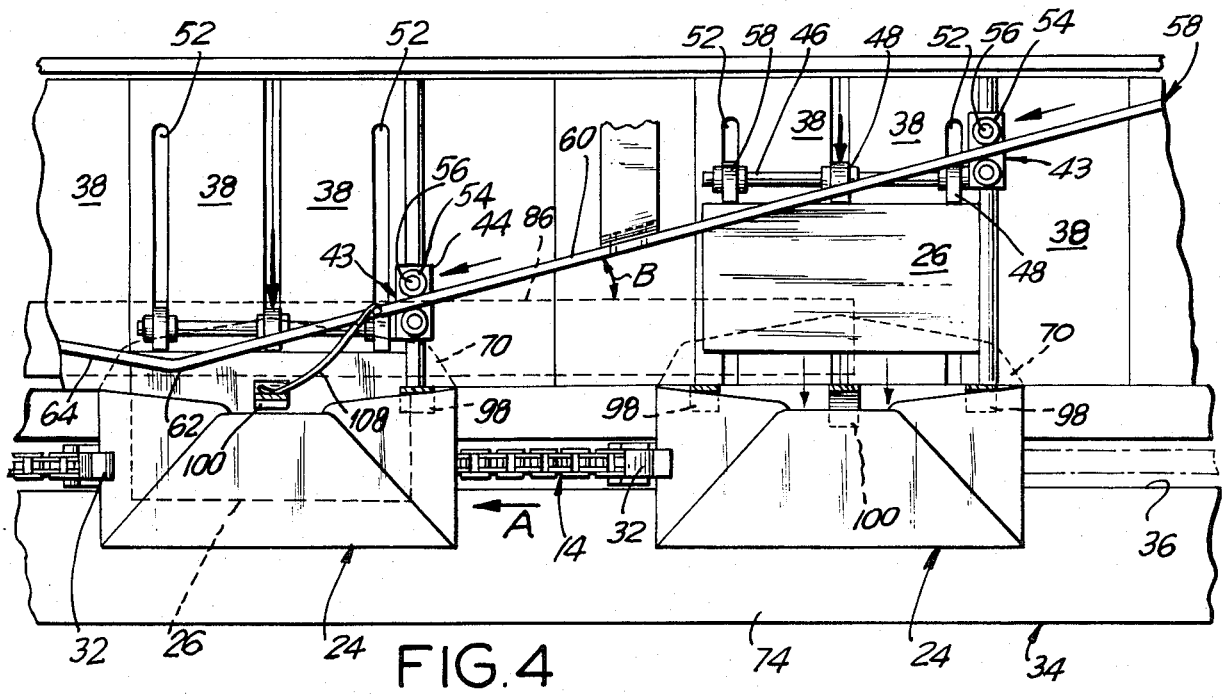
FIG. 4 is a cross-sectional view taken along line 4—4 in FIG. 3.

Referring to FIG. 4, the cooperation between the cam follower rollers 54 and the insert cam 58 causes the insert 26 to advance toward the envelope 24 at the same time that the spring fingers are opening the envelope 24. As a result, the insert 26 can easily be inserted into the envelope 24. The arcuate configuration of the opening portions 104 and 105 of spring fingers 98 and 100 further helps to guide the insert 26 into the envelope 24, assuring that air currents will not cause the insert 26 to slide over the top of envelope 24.

Figure 7:
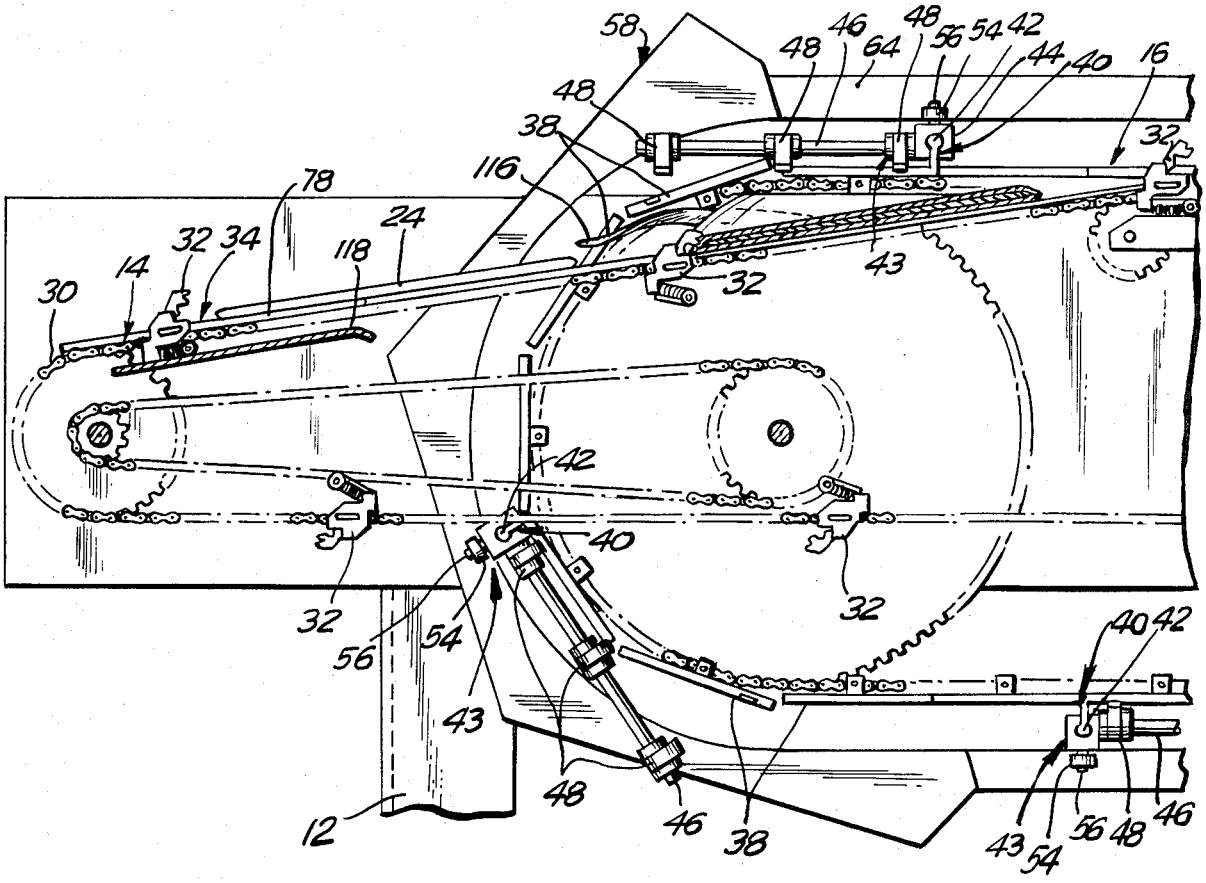
FIG. 7 is a cross-sectional view taken along line 7—7 in FIG. 2.

As explained previously, after the insert 26 has been completely inserted into the envelope 24 the clamp 32 grasps the envelope 24 again and continues to pull the inserted envelope 24 in direction A. As shown in FIG. 7, a flap closing cam 116 is rigidly mounted to frame 12 adjacent the envelope removal portion 78 of platform 34. The flap closing cam 116 is an elongated member which twists 180° along its length and is positioned to cause the flap to rotate from its fully opened position to its fully closed position. As with the flap opening cam 82, the flap closing cam 116 takes advantage of the incline of the envelope removal section 78 of platform 34 relative to the insert conveyor 16. Specifically, the flap 70 rotates from its fully opened position to its fully closed position on the portion of platform 34 adjacent the generally wedge shaped space between the insert conveyor 16 and platform 34, as shown most clearly in FIG. 7.

Additional devices may be provided to ensure that the flap 70 is properly sealed to the envelope 24. For example, an adhesive moistening attachment could be attached to frame 12 to moisten the adhesive on flap 70 as flap 70 passes through an alignment substantially perpendicular to the envelope 24. Additionally, rollers could be provided to ensure that flap 70 is properly pressed against the remainder of envelope 24.

A clamp opening cam is fixedly mounted on frame 12 near the end 120 of platform 34. The clamp opening cam 118 causes the clamp 30 to be opened, thereby releasing the envelope 24. Without the pulling action of the clamp 32 on the envelope 24, friction will cause the envelope 24 to gradually slow down as it reaches the end 120 of platform 34. As the envelope 24 reaches end 120 of platform 34 the next clamp 32 will contact envelope 24 pushing it off the end of platform 34. The envelopes 24 ejected from platform 34 will then be directed to other apparatus as desired for posting, addressing, and/or sorting.

Returning to FIG. 2, the speed at which inserts 26 are sequentially placed in envelopes 24 is determined by two factors. On the one hand, the insertion speed is determined by the linear speed of inserts 26 and envelopes 24 in direction A. On the other hand, the insertion speed also is determined by the angular relationship of the insertion portion 60 of insert cam 58 with respect to longitudinal direction of movement of the envelopes 24, as indicated by arrow A. More particularly, at any given speed for envelopes 24 and inserts 26 in direction A, the insertion speed may be varied by changing the angle B between the insert portion 60 of insert cam 58 and the moving direction of the envelopes 24, as indicated by arrow A. Thus, if the angular relationship between the insertion portion 60 of insert cam 58 is small, the insertion speed may be low even though envelopes 24 are moving at a very high rate of speed in direction A. In this manner, a very high insertion rate may be attained even though the speed at which the inserts 26 approach the envelopes 24 is relatively low. An apparatus 10 adapted to provide a high insertion rate with a low insertion speed would be quite long because of the need for the insertion portion 60 of insert cam 58 to traverse the width of the insert conveyor 16 despite the small angle of the insertion portion 60 with respect to arrow A. The angle B typically would be in the range of 3° to 30°, and preferably in the range of 5° to 20° for most operating conditions. For example, with an angle B of approximately 18.5°, the insertion portion 60 of insert cam 58 would converge toward the envelope conveyor 14 at a ratio of about 3:1. Thus, the envelopes 24 and inserts 26 could be moved in direction A at a rate of about 15,000 per hour, while the inserts 26 would advance towards the envelopes at one-third that speed, which would correspond to an insertion rate of 5,000 per hour. If angle B was reduced to approximately 6°, the insert portion 60 of insert cam 58 would converge toward the envelope conveyor 14 at a ratio of about 10:1. Thus, when the inserts 26 approach the envelopes 24 at the same speed described above, which corresponds to an insertion rate of 5,000 per hour, inserted envelopes actually would be generated at a rate of about 50,000 per hour.

In summary, the apparatus is provided for continuously and sequentially placing inserts in envelopes. The apparatus includes parallel and substantially adjacent insert and envelope conveyors. Inserts are ejected onto the insert conveyor and are moved in a direction parallel to the longitudinal axis of the insert conveyor. An insert cam is provided adjacent the insert conveyor and includes a portion which is angularly disposed with respect to the longitudinal axis of the insert conveyor. The angularly disposed portion of the insert cam causes the inserts to slidably move toward the envelope conveyor as they are being moved in a direction parallel to the longitudinal axes of the envelope and insert conveyors. Envelopes are fed onto the envelope conveyor with their respective flaps face up and adjacent the insert conveyor. A flap opening cam causes the envelope flaps to be opened as the envelopes are advanced along the envelope conveyor. An envelope opening assembly opens the envelopes at the location along the envelope conveyor where the inserts approach the envelope conveyor. The inserts are sequentially but continuously slidably placed in the envelopes, and the envelopes and inserts are moved along the envelope conveyor together. A flap closing cam closes the envelope flap, and the inserted envelopes then are ejected from the apparatus for addressing, posting, or distribution.

What is claimed is:

1. An apparatus for inserting an array of inserts into a corresponding array of envelopes, said apparatus comprising:

an envelope conveyor means for continuously conveying the array of envelopes in a longitudinal direction; and an insert conveyor means for continuously and simultaneously conveying the array of inserts in: (1) a first direction parallel to said longitudinal direction and at the same speed and in the same direction as said array of envelopes; and (2) a second direction extending at an angle to said longitudinal direction, said insert conveyor means comprising an elongated conveyor loop having inner and outer peripheries, and at least one linear bearing fixedly mounted on the outer periphery of said loop such that said linear bearing moves with said loop and causes an insert in said array of inserts to be moved in said first direction, and an insert pusher means slidably mounted on each said linear bearing; and an insert cam, said insert cam including at least one portion disposed at an acute angle to the longitudinal direction, said insert pusher means being operative to follow the insert cam and move the insert in the second direction a sufficient distance to insert the insert into an envelope of the array of envelopes whereby said inserts are sequentially and continuously inserted into said array of envelopes.

2. An apparatus as in claim 1 wherein the envelope conveyor means comprises a platform having an elongated slot and a chain having at least one envelope moving means for moving the envelope, said envelope moving means extending through the slot.

3. An apparatus as in claim 2 wherein the platform includes envelope receiving, envelope insertion and envelope removal sections, said envelope insertion section being parallel and adjacent the insert conveyor means and intermediate the envelope receiving and envelope removal sections, said envelope receiving and removal sections being inclined with respect to said envelope insertion section such that the envelope moves upward on the envelope receiving section and downward on the envelope removal section.

4. An apparatus as in claim 3 further including an envelope opening assembly adjacent the envelope insertion section of the platform, said envelope opening assembly being operative to slightly open the envelope to guide the insert into the envelope.

5. An apparatus as in claim 4 wherein the envelope opening assembly comprises a loop chain, at least one spring finger, a chain driving means for driving the chain at the same speed as the insert and the envelope, and a chain guide means for urging the spring finger into the envelope and opening the envelope.

6. An apparatus as in claim 5 wherein said apparatus includes a flap conveyor and a clamp opening cam adjacent said envelope opening assembly, said flap conveyor being operative to move said envelope in the longitudinal direction and at the same speed as said array of inserts, said envelope opening cam being operative to keep each said clamp open when the envelope is being moved by the flap conveyor thereby enabling the insert to be fully inserted into the envelope.

7. An apparatus as in claim 2 wherein the moving means comprises a clamp for grasping an edge of the envelope.

8. An apparatus as in claim 7 wherein the envelope conveyor means further includes a clamp closing cam disposed on said apparatus in a position to cause said clamp to be closed when the envelope is placed therein.

9. An apparatus as in claim 1 wherein the loop of the insert conveyor means comprises a plurality of hingedly connected plates.

10. An apparatus as in claim 9 wherein each said insert pusher means is slidably mounted on one said linear bearing.

11. An apparatus as in claim 10 wherein each said insert pusher means comprises a block slidably mounted on one said linear bearing, a pair of cam follower rollers rotationally mounted on said block and disposed on opposite sides of the insert cam, an insert pusher bar rigidly mounted on said block and disposed perpendicular to the linear bearing and at least one pusher finger mounted on the insert pusher bar, whereby the cam follower rollers follow the insert cam causing the block to slidably move along the linear bearing and causing the pusher finger to push the insert in the second direction toward the array of envelopes.

12. An apparatus as in claim 11 wherein each said pusher finger includes a notch disposed on the side thereof nearest the envelope conveyor means, said notch being adapted to positively engage the insert and push the insert in the second direction.

13. An apparatus as in claim 11 wherein the portion of the plate adjacent the pusher finger includes a groove for slidably accepting at least a portion of the pusher finger.

14. An apparatus as in claim 11 wherein the insert cam means defines a continuous loop extending continuously about the outer periphery of the insert conveyor means.

15. An apparatus as in claim 9 wherein each said linear bearing is substantially perpendicular to the longitudinal direction.

16. An apparatus as in claim 3 further including a flap opening cam adjacent the envelope receiving section and a flap closing cam adjacent the envelope removal section, said flap opening cam being disposed on said apparatus such that the flap opening cam causes the flap of the envelope to be opened as the envelope is moved along the envelope receiving section and such that the flap of the envelope will be adjacent the inner periphery of the insert conveyor means as the envelope moves along the envelope insertion section.

17. An apparatus as in claim 1 wherein the angle at which said portion of the insert cam is disposed with respect to said longitudinal direction is in the range of 3° to 30°.

18. An apparatus for inserting an array of inserts into a corresponding array of envelopes, said apparatus comprising:

an envelope conveyor means for continuously conveying the array of envelopes in a longitudinal direction, said envelope conveyor means comprising a platform having an elongated slot and a chain having at least one envelope moving means connected thereto and extending through the slot; and an insert conveyor means comprising and elongated conveyor loop having inner and outer peripheries and at least one linear bearing fixedly mounted on the outer periphery of said loop, an insert cam including at least one portion disposed at an acute angle to the longitudinal direction, and an insert pusher assembly slidably mounted on each said linear bearing, said linear bearing continuously conveying an insert of said array of inserts in a first direction parallel to the longitudinal direction and at the same speed and in the same direction as said array of envelopes, while said insert pusher assembly continuously and simultaneously conveys the insert in a second direction extending at an angle to said longitudinal direction, whereby said inserts are sequentially and continuously inserted into said array of envelopes.

* * * * *